United States Patent [19]

Dunlop

[11] 4,223,629

[45] Sep. 23, 1980

[54] MARINE DOCK SECTION

[75] Inventor: Dean A. Dunlop, Don Mills, Canada

[73] Assignee: Swing Stage Limited, Scarborough, Canada

[21] Appl. No.: 907,214

[22] Filed: May 18, 1978

[51] Int. Cl.[3] ..... B63B 35/72

[52] U.S. Cl. ..... 114/263; 405/218; 405/219; 405/221

[58] Field of Search ..... 114/263, 266, 267; 405/218, 219, 220, 221; 182/228

[56] References Cited

U.S. PATENT DOCUMENTS

| | | | |
|---|---|---|---|
| 3,024,753 | 3/1962 | Benson, Jr. | 114/263 |
| 3,106,826 | 10/1963 | Freidel et al. | 405/218 |
| 3,283,517 | 11/1966 | Phillips | 114/266 X |
| 3,760,754 | 9/1973 | Drummond et al. | 114/266 |
| 4,050,257 | 9/1977 | Parks et al. | 405/218 |

FOREIGN PATENT DOCUMENTS

| | | | |
|---|---|---|---|
| 816468 | 7/1959 | United Kingdom | 182/228 |

*Primary Examiner*—Sherman D. Basinger
*Attorney, Agent, or Firm*—Arne I. Fors; Robert F. Delbridge

[57] ABSTRACT

A novel marine dock section adapted to be supported by flotation units or posts is described. A pair of horizontally spaced apart, upright, prefabricated truss-like frameworks, each comprising a pair of longitudinal tubular members preferably of rectangular cross-section secured a spaced distance apart by a plurality of vertical tubular struts extending through and double swaged into the longitudinal tubular members, are joined together by a plurality of cross members to form a planar rectangular frame which supports a wood plank decking.

5 Claims, 5 Drawing Figures

FIG.1.
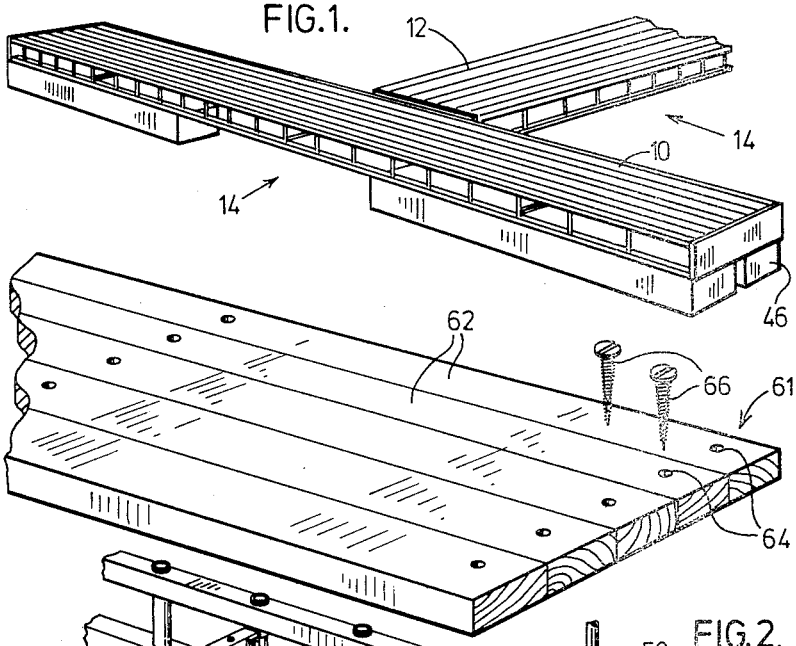
FIG.2.
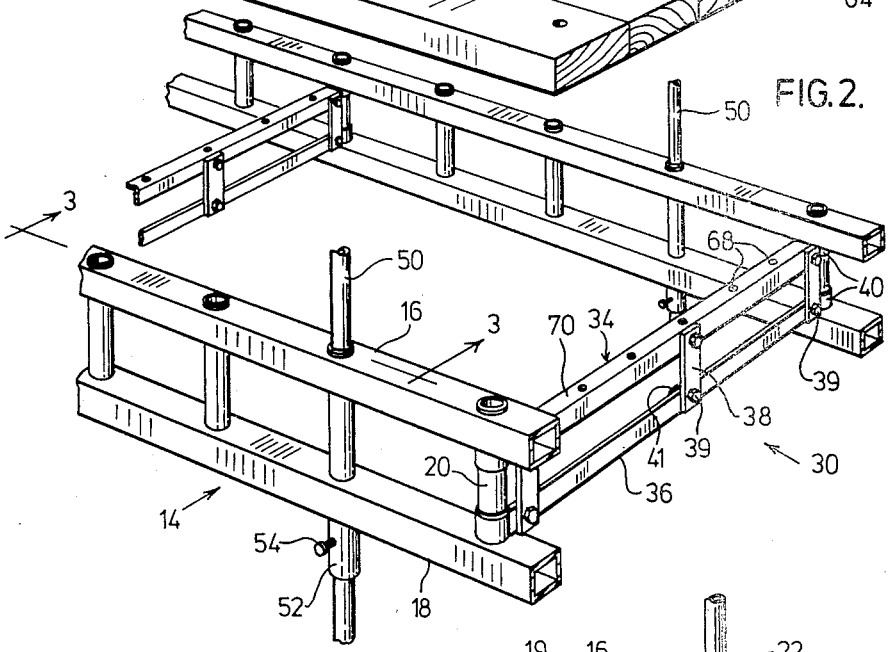
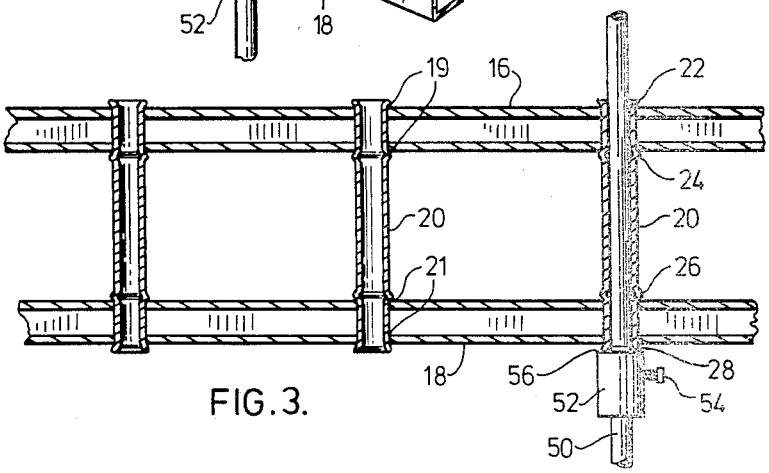
FIG.3.

MARINE DOCK SECTION

BACKGROUND OF THE INVENTION

This invention relates to dock sections and, in particular, is directed to rigid boat dock sections of substantial span which are floatable or which can be supported by post members.

Floating dock sections and post-supported dock sections are well known as typified by U.S. Pats. Nos. 3,053,216; 3,283,517; 3,329,117 and 3,967,569.

It is an important object of the present invention to provide a novel, light-weight dock section which provides a substantial unsupported span suitable for support by spaced flotation units or post members.

It is another object of this invention to provide a novel deck section which is simple and inexpensive to construct and which provides a strong and rigid structure flexible in adaptation for use.

STATEMENT OF INVENTION

These and other objects of the invention are attained from a novel dock section structure comprising, in combination: a pair of horizontally spaced apart elongated prefabricated frameworks, each framework comprising a pair of longitudinal tubular members secured a spaced distance apart by a plurality of equispaced vertical tubular struts rigidly connected to the longitudinal tubular members, a plurality of cross members rigidly interconnecting said prefabricated frameworks forming a planar, rectangular frame, wood plank decking substantially coextensive with said rectangular frame superimposed and seated thereon, and means for securing said decking to said frame.

BRIEF DESCRIPTION OF THE DRAWINGS

The structure of the invention will now be described with reference to the following drawings, in which:

FIG. 1 is a perspective view of dock sections of the present invention supported by spaced flotation means;

FIG. 2 is an exploded perspective view, partly cut away, showing an embodiment of the present invention;

FIG. 3 is a vertical section along line 3—3 of FIG. 2 showing in detail the construction of the prefabricated frameworks;

Like reference characters refer to like parts throughout the description of the drawings.

DESCRIPTION OF THE PREFERRED EMBODIMENTS

Figure 4:
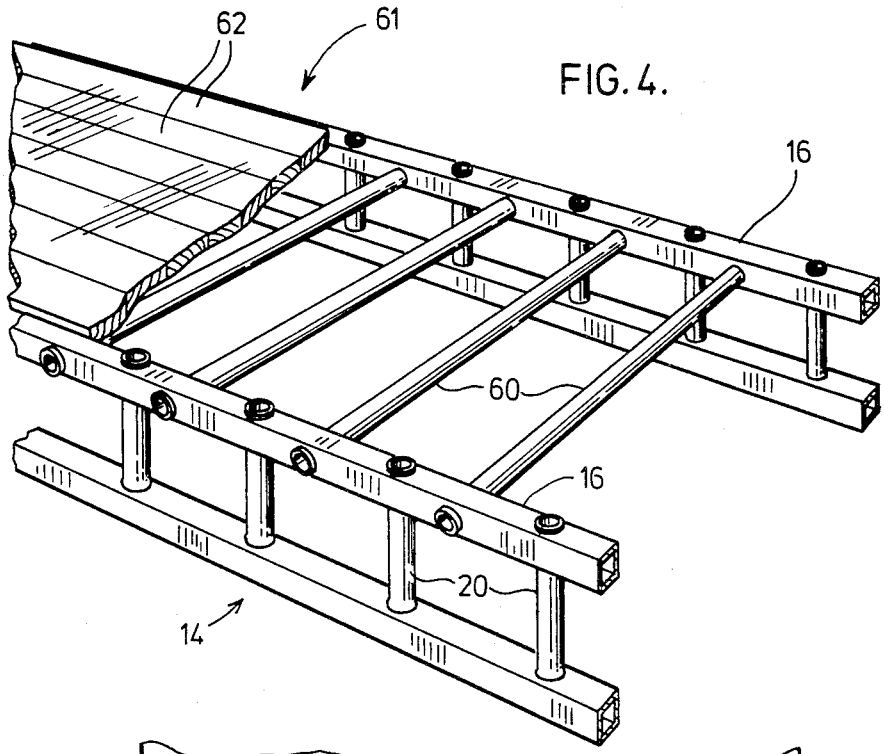
FIG. 4 is a perspective view, partly cut away, of another embodiment of the present invention.

FIG. 1 illustrates dock section 10 disposed transversely to dock section 12, the latter partly cut away; the dock sections interconnected by means of conventional securing means such as bolts and connector plates, not shown. Each of dock sections 10,12 comprises a pair of parallel, horizontally spaced apart elongated prefabricated frameworks designated by numeral 14, shown more clearly in FIGS. 2–5. Frameworks 14 consist of upper and lower parallel longitudinal tubular members 16,18 preferably formed of rectangular cross sections, as illustrated. With particular reference to FIG. 3, longitudinal members 16,18 are formed into a rigid unitary trusstype framework 14 by means of a plurality of vertical tubular struts 20 of circular cross section equispaced along the lengths of and double swaged onto each of longitudinal members 16,18 by insertion into co-extensive holes 19,21 of members 16,18 respectively and upset of the strut metal to form annular shoulders 22,24 and 26,28.

Each of the elongated prefabricated frameworks 14 is secured a spaced horizontal distance apart to form a rigid, planar rectangular frame structure by means of cross members 30 secured to struts 20 at predetermined distances along the length of the structure. Each of cross members 30 comprises an upper angle 34 and a lower planar bar 36 interconnected by means of struts 38 and bolts 39. Cross members 30 are secured to tubular struts 20 by means of clamps 40 encircling struts 20 and connected to members 34,36 by bolts 39 and nuts 41.

FIG. 1 illustrates an embodiment of my invention in which dock section 10 is supported by space float units 46 formed of blocks of flotation material such as closed cell polystyrene foam. Cross members 30 of dock section 10 are seated on the upper surface of the blocks with lateral movement of the blocks relative to the dock section being restrained by longitudinal members 18 of side frameworks 14. FIGS. 2 and 3 illustrate another embodiment of my invention in which the dock sections are supported by posts 50 which are in the form of pipes snuggly fitted through hollow cylindrical struts 20, to be seated on bearing plates not shown, and adjusted as to height by means of sleeves 52 locked onto posts 50 by means of set screw 54 whereby the upper edge of sleeve 52 abuts the lowermost edge of strut 20 at contact line 56.

Figure 5:
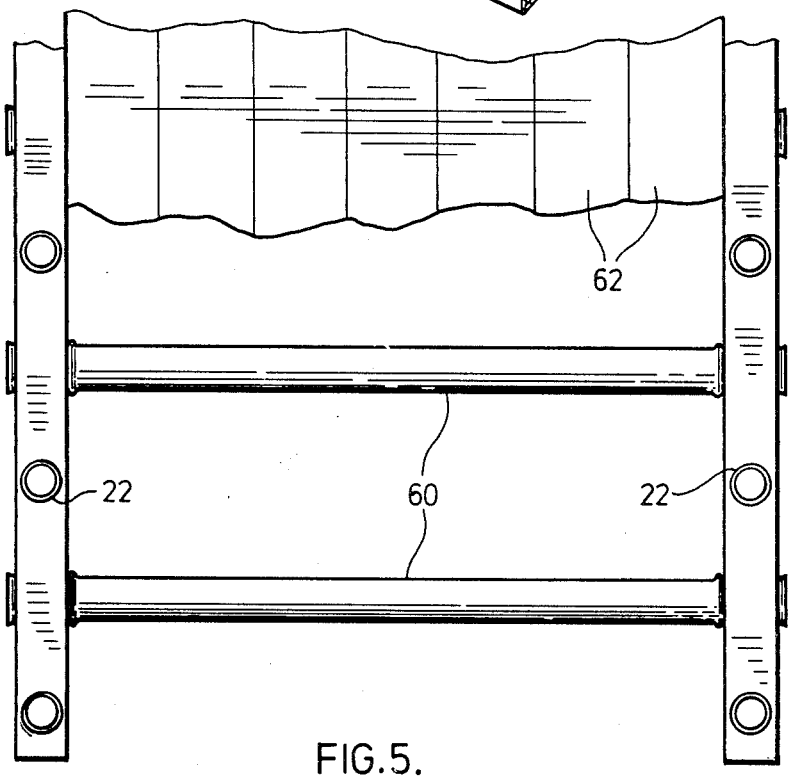
FIG. 5 is a plan view of the embodiment of the invention shown in FIG. 4, partly cut away, showing in detail the interconnection of transverse struts to the prefabricated frameworks.

FIGS. 4 and 5 illustrate another embodiment of my invention in which equispaced transverse struts 60 are double swaged into upper longitudinal members 16 of prefabricated frameworks 14 intermediate vertical struts 20. This latter embodiment may be preferred for narrow sections such as ramps and small docks where light weight and portability are desired.

FIG. 2 shows the decking 61 comprised of planking 62 with holes 64 formed therein permitting drilling and self-tapping screw 66 to be inserted therethrough to form corresponding holes 68 in flange 70 of angle 34 of cross member 30. FIG. 4 illustrates deck 61 seated on transverse struts 60 for securement thereto by drilling and self-tapping screws.

The structure of the present invention provides a number of important advantages. The tubular components 16, 18 and 20 of the prefabricated frameworks, of rectangular or circular cross section, and transverse cylindrical struts 60, are formed from aluminum or steel, preferably of extruded aluminum of about 14 gauge thickness. Members 16,18 may have a $1\frac{3}{4}$ inch square outside dimension and members 20,60 have a $1\frac{1}{4}$ inch outside diameter. Longitudinal members may be spaced apart $5\frac{1}{2}$ inches by struts 20 spaced at 12 inch intervals. The dock sections are formed in widths of 24, 30, 48 or 72 inches and in lengths of up to 32 feet with maximum unsupported spans of 26 feet for a 30 inch width; 20 feet for a 48 inch width; and 16 feet for a 72 inch width when the dock sections are supported by posts.

I have found that with the use of floats the maximum span between floats is about 20 feet for a 30 inch dock width, 16 feet for a 48 inch dock width, and 12 feet for a 72 inch dock width. Aluminum tubular members, struts, cross member components and connectors are preferred for corrosion resistance and light weight. The fabrication of elongated side frameworks by means of double swaging together of component parts permitted by the use of tubular members provides a rigid structure for long unsupported spans.

It will be understood of course that modifications can be made in the embodiment of the invention illustrated and described herein without departing from the scope and purview of the invention as defined by the appended claims.

What I claim as new and desire to protect by Letters Patent of the United States is:

1. A dock section comprising, in combination: a pair of horizontally spaced apart elongated prefabricated frameworks, each framework comprising a pair of parallel, longitudinal, upper and lower tubular members rectangular in cross section secured a spaced distance apart by a plurality of equispaced vertical tubular struts circular in cross section which extend through and are double swaged into the longitudinal tubular members for rigid connection to the longitudinal tubular members, a plurality of cross members rigidly interconnecting said elongated prefabricated frameworks to form a planar, rectangular frame, said cross members each comprising an upper angle and a lower planar bar secured together by vertical struts whereby said upper angle provides a transverse support flange, a circular clamp extending from each of the upper angle and lower planar bar at each end of each cross member for encircling a vertical tubular strut for securement thereto, and wood plank decking substantially coextensive with said rectangular frame seated on the upper angle transverse flanges, and means for securing said decking to said flanges.

2. A dock section comprising, in combination: a pair of horizontally spaced apart elongated prefabricated frameworks, each framework comprising a pair of parallel, longitudinal upper and lower tubular members rectangular in cross section secured a spaced distance apart by a plurality of equispaced vertical tubular struts circular in cross section which extend through and are double swaged into the longitudinal tubular members for rigid connection to the longitudinal tubular members, a plurality of cross members comprising a plurality of equispaced transverse tubular struts circular in cross section which extend through and are double swaged at each end into upper longitudinal tubular members between the vertical tubular struts rigidly interconnecting said elongated prefabricated frameworks to form a planar, rectangular frame, and wood plank decking substantially coextensive with said rectangular frame superimposed and seated thereon.

3. A dock section as claimed in claims 1 or 2 in which said dock section is supported by a plurality of float units formed of foamed polystyrene.

4. A dock section as claimed in claims 1 or 2 in which said dock section is supported by a plurality of posts extending through said vertical tubular struts.

5. A dock section as claimed in claims 1 or 2 in which said elongated prefabricated frameworks, and cross members are fabricated of aluminum.

* * * * *